US007156611B2

(12) United States Patent
Oosawa et al.

(10) Patent No.: US 7,156,611 B2
(45) Date of Patent: Jan. 2, 2007

(54) COUNTERROTATING AXIAL BLOWER

(75) Inventors: Honami Oosawa, Nagano (JP); Katsumichi Ishihara, Nagano (JP); Toshiyuki Nakamura, Nagano (JP); Takashi Kaise, Nagano (JP); Yoshihiko Aizawa, Nagano (JP); Seiji Nishimura, Nagano (JP)

(73) Assignee: Sanyo Denki Co., Ltd., Tokyo (JP)

( * ) Notice: Subject to any disclaimer, the term of this patent is extended or adjusted under 35 U.S.C. 154(b) by 24 days.

(21) Appl. No.: 10/500,603

(22) PCT Filed: Apr. 28, 2003

(86) PCT No.: PCT/JP03/05468

§ 371 (c)(1),
(2), (4) Date: Jun. 30, 2004

(87) PCT Pub. No.: WO2004/081387

PCT Pub. Date: Sep. 23, 2004

(65) Prior Publication Data

US 2005/0106026 A1 May 19, 2005

(30) Foreign Application Priority Data

Mar. 13, 2003 (JP) ..... 2003-068858
Mar. 13, 2003 (JP) ..... 2003-068859

(51) Int. Cl.
*F04D 25/16* (2006.01)
*F01D 1/24* (2006.01)

(52) U.S. Cl. ..... 415/68; 415/199.5; 416/128; 416/198 R

(58) Field of Classification Search ..... 415/199.5, 415/60, 66; 416/20, 128, 198 R
See application file for complete search history.

(56) References Cited

U.S. PATENT DOCUMENTS

| | | | | |
|---|---|---|---|---|
| 6,244,818 | B1 * | 6/2001 | Chang | 415/208.2 |
| 6,540,479 | B1 * | 4/2003 | Liao et al. | 415/199.5 |
| 6,543,726 | B1 * | 4/2003 | Illingworth | 244/204.1 |
| 6,565,334 | B1 * | 5/2003 | Bradbury et al. | 417/423.1 |
| 6,612,817 | B1 | 9/2003 | Lin et al. | |

(Continued)

FOREIGN PATENT DOCUMENTS

| | | |
|---|---|---|
| JP | 11-289742 | 10/1999 |

(Continued)

*Primary Examiner*—Edward K. Look
*Assistant Examiner*—Devin Hanan
(74) *Attorney, Agent, or Firm*—Rankin, Hill, Porter & Clark LLP

(57) ABSTRACT

An axial-flow fan with double impellers is provided that can produce a larger amount of air and a higher static pressure than can be achieved with conventional fans. The axial-flow fan with double impellers has a first axial-flow fan unit and a second axial-flow fan unit. The first axial-flow fan unit includes a first case, a first impeller and a plurality of webs that fix a first motor to the first case. The second axial-flow fan unit includes a second case, a second impeller and a plurality of webs that fix a second motor to the second case. The first case and the second case are coupled together to form a housing. The webs of the first axial-flow fan unit and the webs of the second axial-flow fan unit are combined together to form a plurality of stationary webs arranged in the housing. The number of front blades provided at the first impeller is set to five, the number of stationary blades is set to three, and the number of rear blades provided at the second impeller is set to four.

12 Claims, 9 Drawing Sheets

U.S. PATENT DOCUMENTS

| | | | | |
|---|---|---|---|---|
| 6,652,230 | B1 | 11/2003 | Huang et al. | |
| 6,663,342 | B1 | 12/2003 | Huang et al. | |
| 6,799,942 | B1 * | 10/2004 | Tzeng et al. | 415/61 |
| 6,827,549 | B1 * | 12/2004 | Horng et al. | 415/68 |

FOREIGN PATENT DOCUMENTS

| | | |
|---|---|---|
| JP | 2000-145695 | 5/2000 |
| JP | 2002-349476 | 12/2002 |

* cited by examiner

COUNTERROTATING AXIAL BLOWER

FIELD OF THE INVENTION

The present invention relates to an axial-flow fan with double impellers rotating in mutually opposite directions used to cool an interior of an electric appliance.

DESCRIPTION OF BACKGROUND ART

As an electric appliance becomes smaller in size, so does a space inside a case of the electric appliance in which air flows. To cool an interior of the small case, a fan with features of a large amount of air and a high static pressure is called for. As a fan with such features, an axial-flow fan with double impellers rotating in mutually opposite directions has come to be used in recent years.

For example, U.S. Pat. No. 6,244,818 and Japanese Patent Laid-Open Publication No. 2000-257597 show a fan which comprises a first axial-flow fan unit having a first impeller with nine front blades, a second axial-flow fan unit having a second impeller with nine rear blades, and a case having 13 stationary blades installed between the two axial-flow fan units. This fan can be transformed into an axial-flow fan with double impellers rotating in mutually opposite directions by rotating the first impeller of the first axial-flow fan unit and the second impeller of the second axial-flow fan unit in mutually opposite directions so as to discharge air drawn in by the first axial-flow fan unit from the second axial-flow fan unit.

In recent years some applications call for higher performance than that of the existing axial-flow fan with double impellers rotating in mutually opposite directions.

In the above-described fan, a first case of the first axial-flow fan unit is combined with a second case of the second axial-flow fan unit through a simple coupling structure. For example, a hook attached to one case is fitted in a fitting groove in the other case, and the two cases are rotated relative to each other to engage the hook of one case with the fitting groove of the other case. With this engaging structure, however, an application of a force acting in a direction reverse to the direction in which the two cases were rotated for coupling can easily disengage the two cases.

An object of the present invention is to provide an axial-flow fan with double impellers rotating in mutually opposite directions which is capable of producing a larger amount of air and a higher static pressure than conventional fans do.

Another object of the present invention is to provide an axial-flow fan with double impellers rotating in mutually opposite directions which has a smaller number of parts than that of conventional fans.

Still another object of the present invention is to provide an axial-flow fan with double impellers rotating in mutually opposite directions which produces smaller noise.

Yet another object of the present invention is to provide an axial-flow fan with double impellers rotating in mutually opposite directions in which the first case of the first axial-flow fan unit and the second case of the second axial-flow fan unit are not easily disconnected if they are subjected to a force acting in a direction reverse to the direction in which the two cases were rotated for coupling.

DISCLOSURE OF THE INVENTION

The axial-flow fan with double impellers rotating in mutually opposite directions according to this invention includes a housing, a first impeller, a first motor, a second impeller, a second motor, and a plurality of stationary blades. The housing has an air channel which has a suction opening portion on one of two axial-end sides thereof and a discharge opening portion on the other axial-end side thereof. The first impeller has a plurality of front blades that rotate in the suction opening portion. The first motor rotates the first impeller about an axis in one of two rotating directions. The second impeller has a plurality of rear blades that rotate in the discharge opening portion. The second motor rotates the second impeller about the axis in the other rotating direction opposite to the one direction. The stationary blades are arranged stationary in the housing between the first impeller and the second impeller and extend radially. Here, the word "radially" applies to not only a case where the blades extend radially in straight lines but also a case where they extend radially in curved lines.

The axial-flow fan with double impellers rotating in mutually opposite directions according to this invention includes five front blades, three stationary blades and four rear blades. The inventor of this invention studied a relation between the number of front, stationary and rear blades and characteristics of the fan. The study found that the above-mentioned combination of the blade numbers defined in this invention can produce a large amount of air and a higher static pressure than other blade number combinations. The above blade number combination is also found to produce less noise than other blade number combinations. Therefore, the axial-flow fan with double impellers rotating in mutually opposite directions according to this invention can increase the air amount and the static pressure and also reduce noise, when compared with conventional fans.

The housing may be formed as one integral structure but it may also be formed of two or more constitutional parts. For example, when the axial-flow fan with double impellers rotating in mutually opposite directions according to this invention is made by combining two axial-flow fan units, the housing is constructed by combining the cases of the two axial-flow fan units.

When a first axial-flow fan unit and a second axial-flow fan unit are combined together to form the axial-flow fan with double impellers rotating in mutually opposite directions, the first axial-flow fan unit comprises a first case, a first impeller, a first motor and three webs. The first case has an air channel having a suction opening portion on one of two axial-end sides thereof and a discharge opening portion on the other axial-end side thereof. The first impeller has a plurality of front blades that rotate in the suction opening portion. The first motor rotates the first impeller about the axis in one of two rotating directions. The three webs are arranged in the discharge opening portion and circumferentially spaced apart to secure the first motor to the first case. Similarly, second axial-flow fan unit comprises a second case, a second impeller, a second motor and three webs. The second case has an air channel having a suction opening portion on one of two axial-end sides thereof and a discharge opening portion on the other axial-end side thereof. The second impeller has a plurality of rear blades that rotate in the discharge opening portion. The second motor rotates the second impeller about the axis in the other rotating direction opposite to the one direction. The three webs are arranged in the suction opening portion and circumferentially spaced apart to secure the second motor to the second case. The first case of the first axial-flow fan unit and the second case of the second axial-flow fan unit are coupled together to form the housing. In that case, the three webs of the first axial-flow fan unit and the three webs of the second axial-flow fan unit are preferably combined to form three radially extending stationary blades arranged stationary in the housing between the first impeller and the second impeller. With this arrangement, there is no need to construct a case having three stationary blades separately from the axial-flow fan units, reducing the number of parts used in the axial-flow fan with double impellers rotating in mutually opposite directions. Further, compared with a case where a separate unit having a plurality of stationary blades is used, the axial-flow fan with double impellers rotating in mutually opposite directions according to this invention can be reduced in an axial overall size.

More specifically, the front blades are curved in a transverse cross section of the front blades as taken along a direction parallel to the axis (or along the axis) so that their concave portions are open toward the rotating direction of the first impeller, i.e., in the one direction as described above. The rear blades are curved in a transverse cross section of the front blades as taken along a direction parallel to the axis so that their concave portions are open toward the rotating direction of the second impeller, i.e., in the other direction as described above. In this construction, the stationary blades are preferably curved in a transverse cross section of the front blades as taken along a direction parallel to the axis so that their concave portions are open toward the other direction (the rotating direction of the second impeller) and toward a direction in which the rear blades are positioned. With this arrangement, it is possible to increase the maximum amount of air and the maximum static pressure and reduce the suction noise.

In an example, the first impeller may have an annular peripheral wall surrounding the axis on which base portions of five front blades are integrally mounted. The second impeller may have an annular peripheral wall surrounding the axis on which base portions of four rear blades are integrally mounted. This arrangement allows the first and second impellers to be formed easily by resin injection molding.

The rotating speed of the second impeller is preferably set slower than that of the first impeller for reduced noise.

Another axial-flow fan with double impellers rotating in mutually opposite directions according to this invention has a first axial-flow fan unit and a second axial-flow fan unit. The first axial-flow fan unit comprises: a first case including therein an air channel which has a suction opening portion on one of two axial-end sides thereof and a discharge opening portion on the other axial-end side thereof; and a first impeller having a plurality of blades and being adapted to rotate in the suction opening portion. The second axial-flow fan unit comprises: a second case including therein an air channel which has a suction opening portion on one of two axial-end sides thereof and a discharge opening portion on the other axial-end side thereof; and a second impeller having a plurality of blades and being adapted to rotate in the discharge opening portion. Then, the first case of the first axial-flow fan unit and the second case of the second axial-flow fan unit are combined through a coupling structure. In this invention, the coupling structure comprises: two kinds of engaged portions provided at an end portion surrounding a periphery of the discharge opening portion of the first case of the first axial-flow fan unit; and two kinds of engaging portions provided at an end portion surrounding a periphery of the suction opening portion of the second case of the second axial-flow fan unit and adapted to engage with the two kinds of engaged portions. Then, the two kinds of engaging portions and the two kinds of engaged portions include: a first kind of the engaging portions and a first kind of the engaged portions together forming a first kind of engaging structure; and a second kind of the engaging portions and a second kind of the engaged portions together forming a second kind of engaging structure. The first kind of engaging structure is adapted to resist a separation operation when the first case and the second case in a coupled state are subjected to the separation operation which acts to axially separate the first case and the second case, and to resist a first rotation operation when the first case and the second case in a combined state are subjected to the first rotation operation which acts to rotate the first case about an axis relative to the second case in one of two rotating directions. The second kind of engaging structure is adapted to resist a second rotation operation when the first case and the second case in a coupled state are subjected to the second rotation operation which acts to rotate the first case about the axis relative to the second case in the other rotating direction opposite to the one direction. With the above coupling structure of this invention comprising the first kind of engaging structure and the second kind of engaging structure, when the first rotation operation to couple the first case to the second case is performed, the first kind of engaging structure resists the first rotation operation. When the second rotation operation to rotate the first case relative to the second case in the other rotating direction opposite to the one rotating direction is performed, the second kind of engaging structure resists the second rotation operation. Therefore, if the first axial-flow fan unit and the second axial-flow fan unit are subjected to a force acting in a direction (the other direction) opposite to the direction (the one direction) in which they are rotated for coupling, the second kind of engaging structure can prevent a possible decoupling of the two fan units.

The first kind of the engaging portions and the first kind of the engaged portions together forming the first kind of engaging structure can be brought into an engaged state by bringing the end portion of the first case and the end portion of the second case close together, and the second kind of the engaging portions and the second kind of the engaged portions together forming the second kind of engaging structure can be brought into an engaged state by rotating the first case about the axis relative to the second case in the one of two rotating directions. This coupling arrangement allows the first case and the second case to be coupled together easily with a simple action by utilizing the first kind of engaging structure.

The first kind of the engaging portion may be constructed of a hook having a first engaging surface and a second engaging surface. The first engaging surface is adapted to engage with a first engaged surface of the first kind of the engaged portion when the first case and the second case in a coupled state are subjected to the separation operation that acts to axially separate the two cases. The second engaging surface is adapted to engage with a second engaged surface of the first kind of the engaged portion when the first case and the second case in a coupled state are subjected to the first rotation operation that acts to rotate the first case about the axis relative to the second case in the one direction. The second kind of the engaging portion may be constructed of a protrusion having a third engaging surface. The third engaging surface is adapted to engage with a third engaged surface of the second kind of the engaged portion when the first case and the second case in a coupled state are subjected to the second rotation operation that acts to rotate the first case about the axis relative to the second case in the other direction. The first kind of the engaged portion may be formed of a first fitting groove having the first and second engaged surfaces. The second kind of the engaged portion may be formed of second fitting groove having the third engaged surface. Constructing the engaging portions and the engaged portions as described above allows the first and second kind of engaging structure to be formed in simpler configurations.

In an example of the axial-flow fan with double impellers rotating in mutually opposite directions according to this invention, the end portions of the first case and the second case have an almost rectangular outline and one first fitting groove and one second fitting groove are formed in each of at least three of four corner portions of the first case. Further, one hook and one protrusion are integrally provided at each of at least three of four corner portions in the end portion of the second case. The hooks and the first fitting grooves are so shaped as to form a first kind of engaging structure. The first kind of engaging structure is adapted to resist a separation operation when the first case and the second case in a coupled state are subjected to the separation operation which acts to axially separate the first case and the second case. The first kind of engaging structure is also adapted to resist a first rotation operation when the first case and the second case in a combined state are subjected to the first rotation operation which acts to rotate the first case about an axis relative to the second case in one of two rotating directions. The protrusions and the second fitting grooves are so shaped as to form a second kind of engaging structure. The second kind of engaging structure is adapted to resist a second rotation operation when the first case and the second case in a coupled state are subjected to the second rotation operation which acts to rotate the first case about the axis relative to the second case in the other rotating direction opposite to the one rotating direction. With this arrangement the coupling structures are formed at the corner portions of each case, firmly coupling the first case and the second case with a good balance.

BEST MODE FOR IMPLEMENTING THE INVENTION

Figure 1:
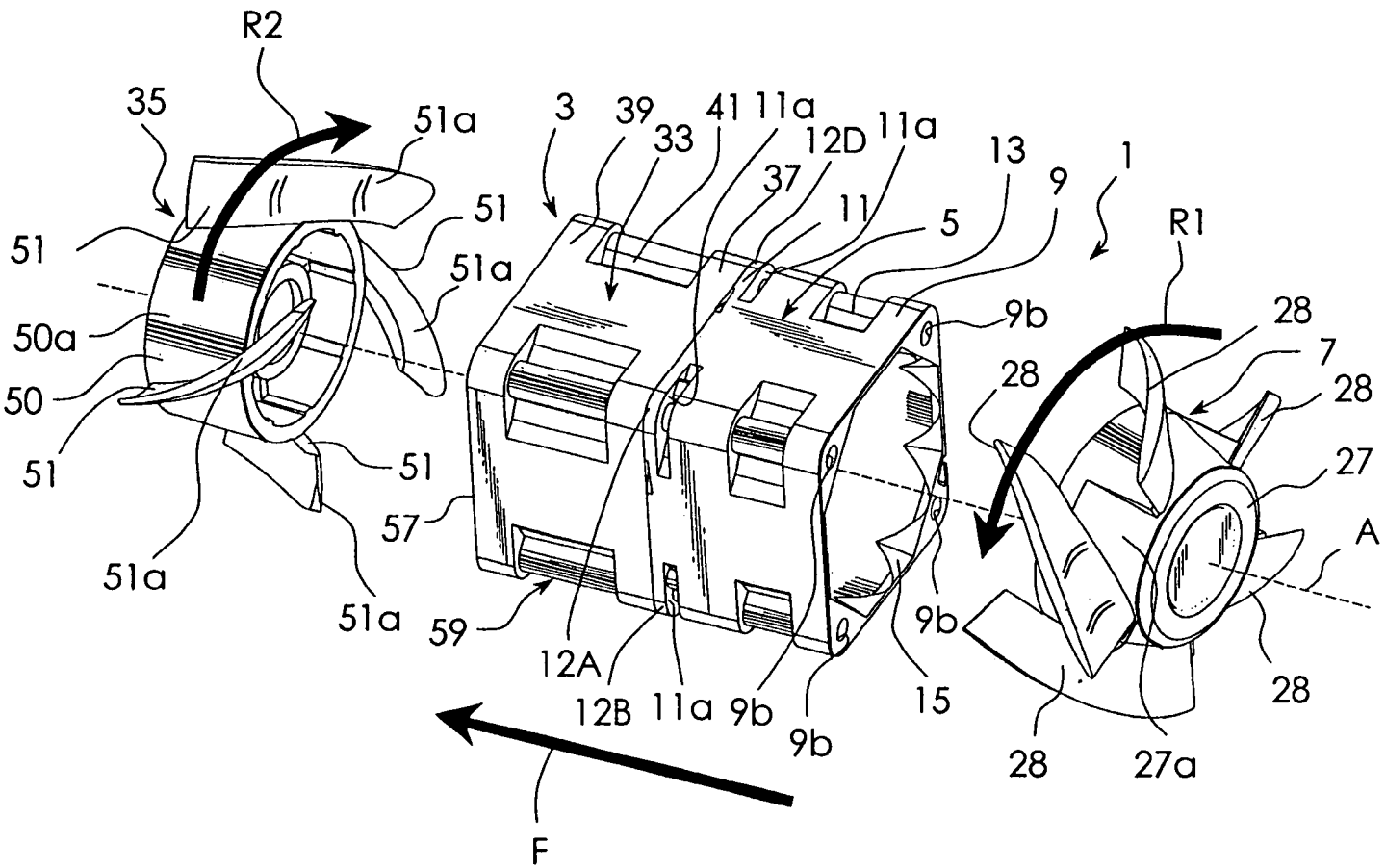
FIG. 1 is an exploded perspective view of an axial-flow fan with double impellers rotating in mutually opposite directions according to one embodiment of the invention.
Figure 2:
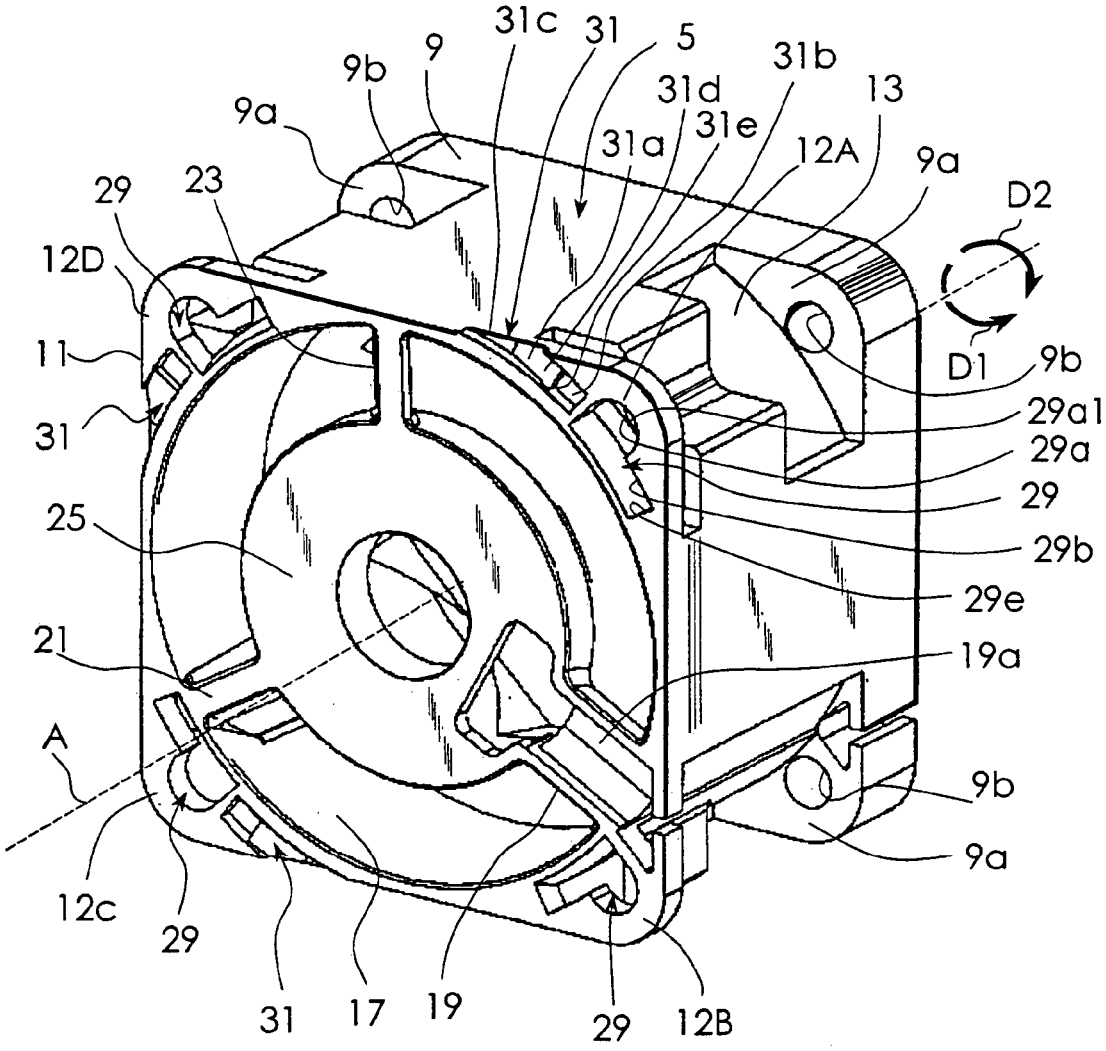
FIG. 2 is a perspective view showing a first case of a first axial-flow fan unit in the axial-flow fan with double impellers rotating in mutually opposite directions of FIG. 1.
Figure 3:
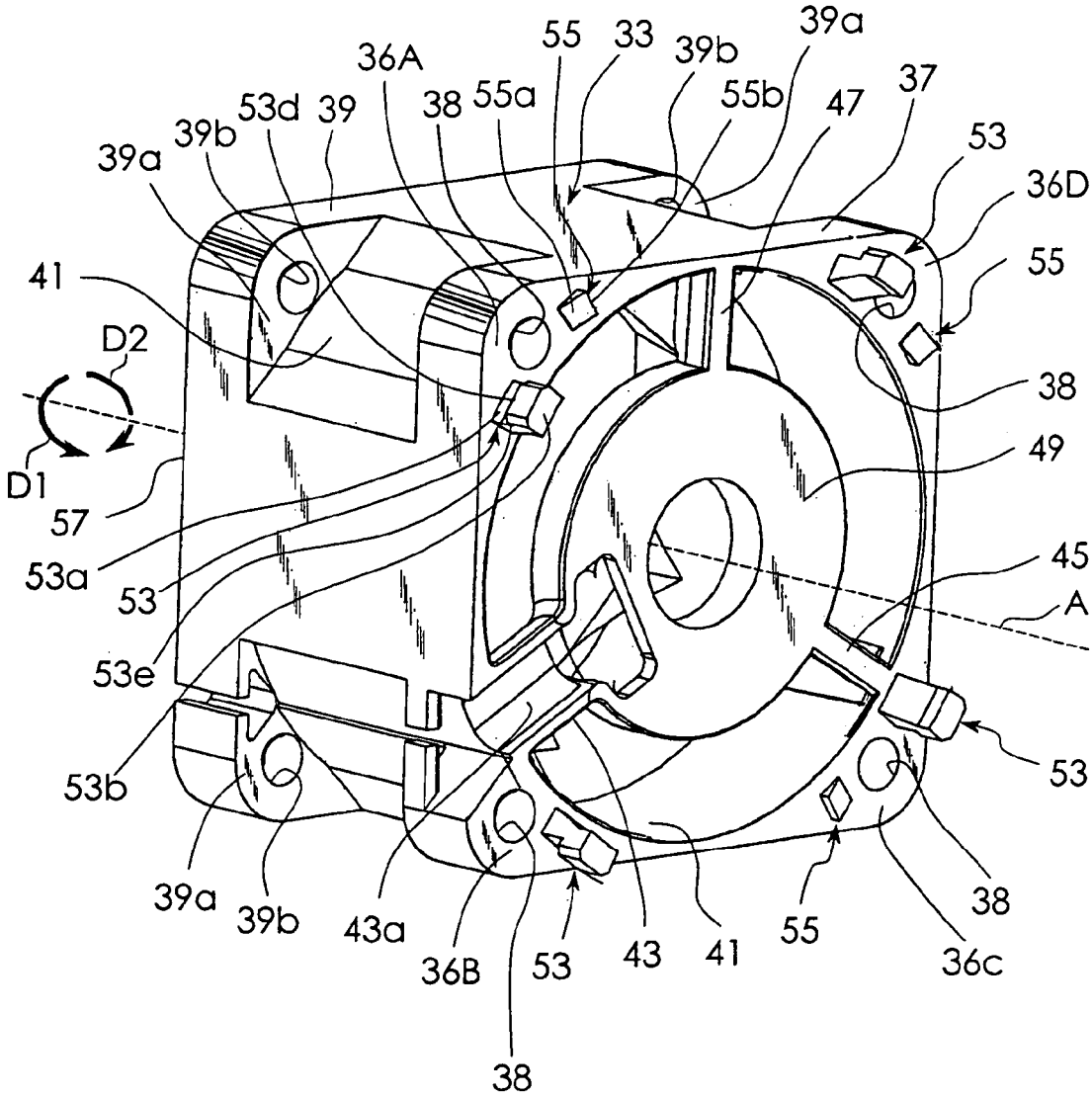
FIG. 3 is a perspective view showing a second case of a second axial-flow fan unit in the axial-flow fan with double impellers rotating in mutually opposite directions of FIG. 1.

Now, embodiments of the present invention will be described by referring to the accompanying drawings. FIG. 1 shows an exploded perspective view of an axial-flow fan with double impellers rotating in mutually opposite directions as one embodiment of the invention. As shown in the figure, the axial-flow fan with double impellers rotating in mutually opposite directions has a first axial-flow fan unit 1 and a second axial-flow fan unit 3 combined together through a coupling structure. FIG. 2 is a perspective view of the first axial-flow fan unit 1 and FIG. 3 is a perspective view of the second axial-flow fan unit 3.

The first axial-flow fan unit 1 has a first case 5, a first impeller (front impeller) 7 installed in the first case 5, a first motor 25 shown in FIG. 2, and three webs 19, 21, 23 shown in FIG. 2. In FIG. 1 the first impeller (front impeller) 7 is shown exaggerated in size. The first case 5, as shown in FIG. 1 and FIG. 2, has an annular suction-side flange 9 on one of two ends on the axial line A (in an axial direction) and an annular discharge-side flange 11 on the other side. The first case 5 also has a cylindrical portion 13 between the two flanges 9, 11. The flanges 9, 11 and an inner space in the cylindrical portion 13 all together form an air channel.

FIG. 2 is a perspective view of the first case 5 of the first axial-flow fan unit 1 as seen from the coupled portion between the first case 5 and the second axial-flow fan unit 3 by separating the second axial-flow fan unit 3 from the first axial-flow fan unit 1 of the axial-flow fan with double impellers rotating in mutually opposite directions of FIG. 1. The suction-side flange 9 has an almost rectangular outline, with an octagonal suction opening portion 15 formed therein. The suction-side flange 9 has at its four corner portions flat faces 9*a* facing toward the cylindrical portion 13 and through-holes 9*b* for mounting screws.

The discharge-side flange 11 also has an almost rectangular outline with a circular discharge opening portion 17 formed therein. In the discharge opening portion 17, three radially extending webs 19, 21, 23 are arranged at circumferentially equal intervals. Through the three webs 19, 21, 23, a motor case in which a stator of the first motor 25 is fixed is secured to the first case 5. Of the three webs 19, 21, 23, the web 19 has a groove-shaped recessed portion 19*a* opening toward the second axial-flow fan unit 3. In this recessed portion 19*a* is installed a feeder wire not shown which is connected to an excitation winding of the first motor 25. The three webs 19, 21, 23 are respectively combined with three webs 43, 45, 47, described later, of the second axial-flow fan unit 3 to form three stationary blades 61 (FIG. 5) described later.

The first motor 25 comprises a rotor not shown, to which the first impeller 7 of FIG. 1 is mounted, and a stator for rotating the rotor. The first motor 25 rotates the first impeller 7 in the suction opening portion 15 of the first case 5 counterclockwise in FIG. 1 (i.e., in a direction of arrow R1, or in one rotating direction). The first motor 25 rotates the first impeller 7 at a speed faster than a second impeller 35 described later. The first impeller 7 has an annular member 27 fitted with a cup-shaped member not shown, which as a rotor is secured to a rotating shaft not shown of the first motor 25, and five front blades 28 integrally provided on an outer peripheral surface of an annular wall 27*a* of the annular member 27.

Figure 4:
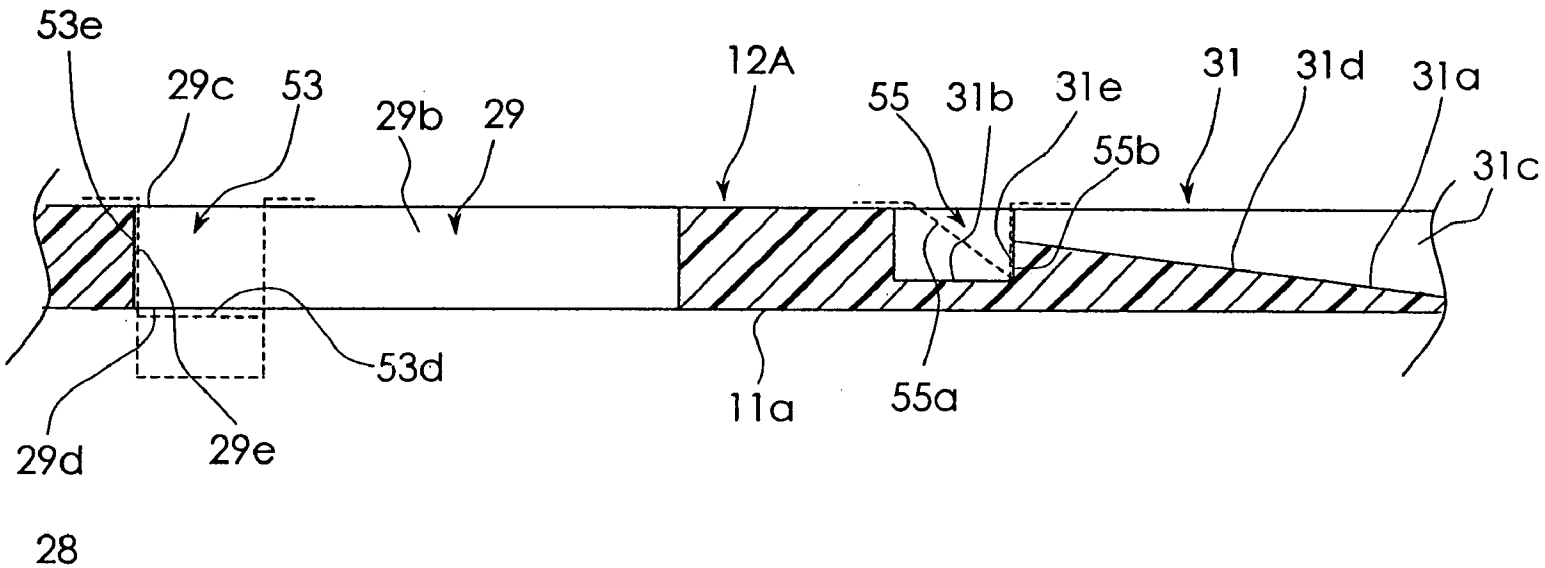
FIG. 4 is an enlarged cross-sectional view showing a coupling structure of the axial-flow fan with double impellers rotating in mutually opposite directions of FIG. 1.

The discharge-side flange 11 has flat faces 11*a* formed one at each of four corner portions 12A–12D and facing toward the cylindrical portion 13. At the four corner portions 12A–12D are formed four first fitting grooves 29 that constitute a first kind of engaged portions, as shown in FIG. 2. These first fitting grooves 29 are formed by through-holes piercing through the discharge-side flange 11. Here a construction of the first fitting groove 29 formed in the corner portion 12A will be explained. The first fitting groove 29 has a hook passing hole 29*a* and a hook moving hole 29*b* contiguous with the hook passing hole 29*a*. The hook passing hole 29*a* has a semicircular portion 29*a*1 which also serves as a through-hole through which the mounting screw passes. The hook moving hole 29*b* is shaped like an arc. At its end portion 29*c* when seen in the rotating direction R1 of the first impeller 7, the hook moving hole 29*b*, as shown in FIG. 4, is formed with a first engaged surface 29*d* and a second engaged surface 29*e* to be engaged by a hook 53 described later. FIG. 4 is a partial cross-sectional view of the corner portion 12A taken along the first fitting groove 29 and a second fitting groove 31 described later. The first engaged surface 29*d* is situated at the corner portion 12A and is formed by a part of the flat face 11*a* (FIG. 1) situated close to the end portion 29*c* of the hook moving hole 29*b*. The second engaged surface 29*e* is formed by an end face, on the rotating direction side, of the hook moving hole 29*b*.

Except for the corner portion 12B adjacent to the web 19 in which a wire not shown is installed, the three corner portions 12A, 12C, 12D are each formed with a second fitting groove 31 that constitutes a second kind of engaged portion. As shown in FIG. 4, the second fitting groove 31 has a protrusion moving groove 31*a* and an engaging groove 31*b* contiguous with the protrusion moving groove 31*a*. The protrusion moving groove 31*a* has an opening 31*c* opening toward a side surface of the discharge-side flange 11. The protrusion moving groove 31*a* has a bottom surface 31*d* which is sloping in such a manner that it approaches the second axial-flow fan unit 3 as it extends from the opening 31*c* toward the engaging groove 31*b*. As a result, a step is formed between the engaging groove 31*b* and the protrusion moving groove 31*a*. An inner surface of the engaging groove 31*b* situated on the protrusion moving groove 31*a* side constitutes a third engaged surface 31*e*.

The second axial-flow fan unit 3 has a second case 33, a second impeller (rear impeller) 35 of FIG. 1 installed in the second case 33, a second motor 49 of FIG. 3, and three webs 43, 45, 47 of FIG. 3. In FIG. 1, the second impeller (rear impeller) 35 is shown exaggerated in size. The second case 33, as shown in FIG. 1 and FIG. 3, has a suction-side flange 37 on one of two ends on the axial line A (in an axial direction) and a discharge-side flange 39 on the other end. The second case 33 also has a cylindrical portion 41 between the two flanges 37, 39. The flanges 37, 39 and an inner space in the cylinder portion 41 all together form an air channel. FIG. 3 is a perspective view of the second case 33 of the second axial-flow fan unit 3 as seen from the coupled portion between the second case 33 and the first axial-flow fan unit 1 by separating the first axial-flow fan unit 1 from the second axial-flow fan unit 3 of the axial-flow fan with double impellers rotating in mutually opposite directions of FIG. 1.

The suction-side flange 37 has an almost rectangular outline, with a circular suction opening portion 41 formed therein. In the suction opening portion 41, three radially extending webs 43, 45, 47 are arranged at circumferentially equal intervals. The second motor 49 is secured to the second case 33 through the three webs 43, 45, 47. Of the three webs 43, 45, 47, the web 43 has a groove-shaped recessed portion 43*a* opening toward the first axial-flow fan unit 1. In this recessed portion 43*a* is installed a feeder wire not shown which is connected to an excitation winding of the second motor 49. The three webs 43, 45, 47 combine with three webs 19, 21, 23 of the first axial-flow fan unit 1 to form three stationary blades 61 (FIG. 5) described later.

The second motor 49 comprises a rotor not shown to which the second impeller 35 of FIG. 1 is mounted and a stator that rotates this rotor. The second motor 49 rotates the second impeller 35 in a discharge opening portion 57 clockwise in FIG. 1 [in the direction of arrow R2 in the figure, i.e., in a direction opposite to the rotating direction (arrow R1) of the first impeller 7]. As described above, the second impeller 35 is rotated at a speed slower than that of the first impeller 7.

The second impeller 35 has an annular member 50 fitted with a cup-shaped member not shown, which as a rotor is secured to a rotating shaft not shown of the second motor 49, and four rear blades 51 integrally provided on an outer peripheral surface of an annular wall 50*a* of the annular member 50.

Four corner portions 36A–36D of the suction-side flange 37 are each formed with a through-hole 38 through which a mounting screw passes, as shown in FIG. 3. Each of the four corner portions 36A–36D also has a hook 53 formed integral therewith which constitutes a first kind of engaging portion. The hooks 53 protrude toward the first case 5. The construction of the hook 53 at the corner portion 36A will be explained. The hook 53 has a body portion 53*a* rising along the axis A from the corner portion and a head portion 53*b* attached at a front end of the body portion 53*a*. The head portion 53*b* at the front end of the body portion 53*a* bulges outwardly in a radial direction, gradually away from the axis A, thus forming a step between the head portion 53*b* and the body portion 53*a*. A surface of this step forms a first engaging surface 53*d* that engages with the first engaged surface 29*d*. Except for the corner portion 36B adjacent to the web 43, the three corner portions 36A, 36C, 36D are each formed integrally with a protrusion 55, which constitutes a second kind of engaging portion in such a manner that the through-hole 38 is located between the hook 53 and the protrusion 55. The protrusion 55 protrudes toward the first case 5 along the axis A, as with the hooks 53. The protrusion 55 has an inclined surface 55*a* which is sloping in such a manner that it approaches the first case 5 as it departs away from the hook 53 situated in the same corner portion. This inclined surface 55*a* slides on a sloped surface forming the bottom surface 31*d* of the protrusion moving groove shown in FIG. 4. The protrusion 55 has an end face 55*b* extending along the axis from an end of the inclined surface 55*a* toward the second case 33. This end face 55*b* forms a third engaging surface that engages with the third engaged surface 31*e* formed in the engaging groove 31*b*.

The discharge-side flange 39 has an almost rectangular outline, with an octagonal discharge opening portion 57 formed therein. (The discharge opening portion is situated on the back side of FIG. 3 and its reference numeral is shown only for convenience.) The discharge-side flange 39 has flat faces 39*a* formed one at each of the four corner portions on the side of the cylinder portion 41. The four corner portions are each formed with a through-hole 39*b* through which a mounting screw passes.

In this example of the fan, the first case 5 of the first axial-flow fan unit 1 and the second case 33 of the second axial-flow fan unit 3 are combined as follows. First, the end portion of the first case 5 and the end portion of the second case 33 are brought close together, and the head portions 53*b* of the four hooks 53 of the second case 33 are inserted into the corresponding hook passing holes 29*a* of the four first fitting grooves 29 in the first case 5. At this time, the three protrusions 55 of the second case 33 fit into the openings 31*c* of the three second fitting grooves 31 in the first case 5. Next, as shown in FIG. 2 and FIG. 3, these cases 5, 33 are rotated clockwise in one direction (indicated by arrow D1) relative to each other. This rotation may be achieved either by rotating both of the cases or only one case relative to the other. This rotation causes the body portions 53*a* of the hooks 53 to move in the hook moving holes 29*b* of the first fitting grooves 29 until the first engaging surfaces 53*d* of the head portions 53*b* of the hooks 53 abut onto the first engaged surfaces 29*d* on the flat faces 11*a* of the discharge-side flange 11 and the second engaging surfaces 53*e* of the body portions 53*a* abut onto the second engaged surfaces 29*e* of the discharge-side flange 11, thus preventing the hooks 53 from coming off from the first fitting grooves 29. Further, the protrusions 55 move in the protrusion moving grooves 31*a* of the second fitting grooves 31 until they fit into the engaging grooves 31*b*. The end faces 55*b* of the protrusions 55 engage with the third engaged surfaces 31*e* formed in the engaging grooves 31*b*.

In this embodiment, the hooks 53 (first kind of engaging portions) and the first fitting grooves 29 (first kind of engaged portions) are combined to form a first kind of engaging structure. The protrusions 55 (second kind of engaging portions) and the second fitting grooves 31 (second kind of engaged portions) are combined to form a second kind of engaging structure. With this construction, when a separating action to move in the axial direction the first case 5 and the second case 33 out of engagement with each other, the first engaging surfaces 53*d* of the head portions 53*b* of the hooks 53 engage with the first engaged surfaces 29*d* on the flat faces 11*a* of the discharge-side flange 11, activating the first kind of engaging structure to resist the separating action. Further, when a first rotating action is performed to rotate the first case 5 and the second case 33, in a combined state, about the axis A in one direction indicated by arrow D1, the second engaging surfaces 53*e* of the body portions 53*a* engage with the second engaged surface 29*e* of the discharge-side flange 11, activating the first kind of engaging structure to resist the first rotating action. When a second rotating action is performed to rotate the first case 5 and the second case 33, in a coupled state, about the axis A in a direction indicated by arrow D2, opposite to the one direction (arrow D1), the end faces 55*b* of the protrusions 55 forming the third engaging surfaces engage with the third engaged surfaces 31*e* of the engaging grooves 31*b* of the second fitting grooves 31, activating the second kind of engaging structure to resist the second rotating action. Thus, in the fan of this embodiment, even if the first case 5 and the second case 33 are subjected to a force acting in the direction of arrow D1 or a force acting in the direction of arrow D2, they are prevented from being disconnected.

Figure 5:
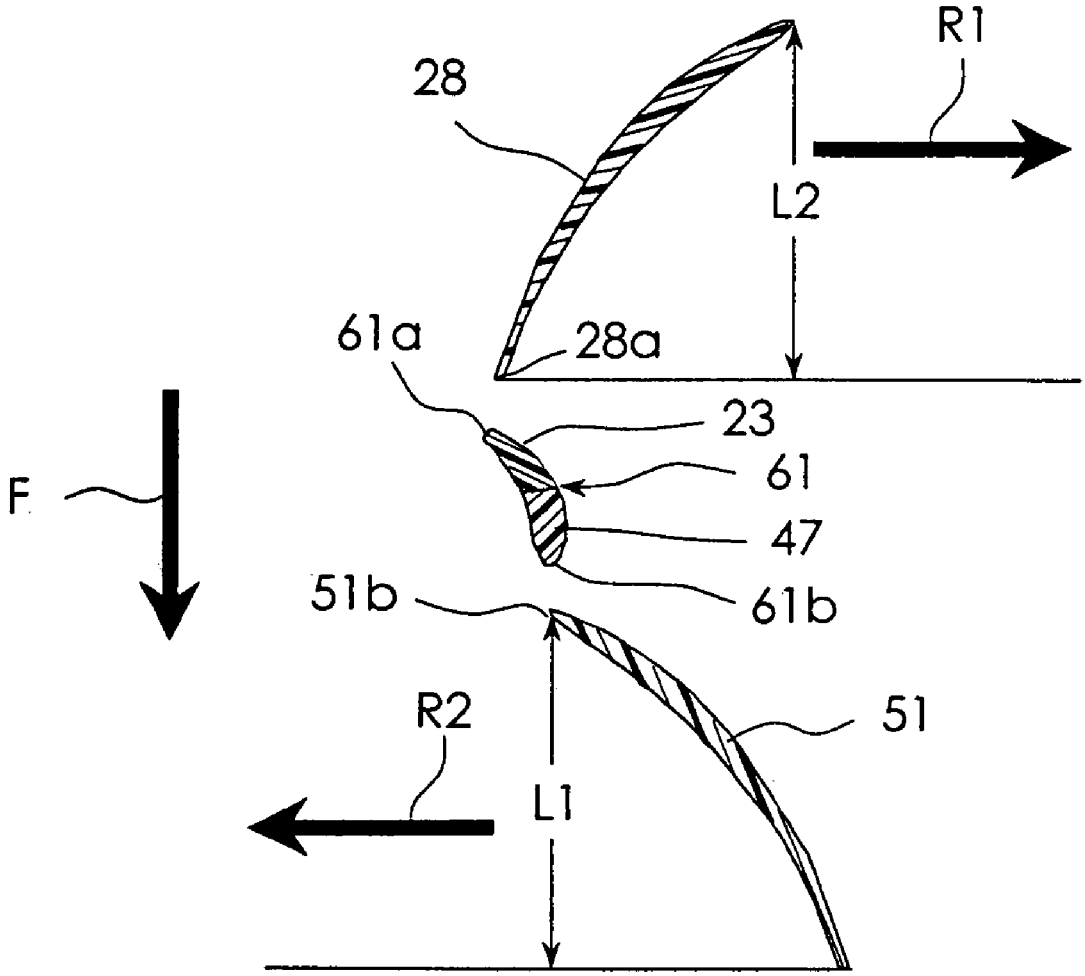
FIG. 5 is a transverse cross-sectional view, taken along a direction parallel to an axis of the axial-flow fan with double impellers rotating in mutually opposite directions in FIG. 1, of a front blade, a rear blade and a stationary blade.

As shown in FIG. 1, in the fan of this embodiment, the first case 5 and the second case 33 are combined to form a housing 59; and the webs 19, 21, 23 of the first axial-flow fan unit 1 and the webs 43, 45, 47 of the second axial-flow fan unit 3 are combined to form three radially extending stationary blades 61 (FIG. 5) disposed stationary in the housing 59 between the first impeller 7 and the second impeller 35. When the first impeller 7 rotates in one direction R1 and the second impeller 35 in the other direction R2, air is moved in a direction F from the suction opening portion 15 toward the discharge opening portion 57. FIG. 5 shows a front blade 28, a rear blade 51 and a stationary blade 61 in a transverse cross-sectional view taken along a direction parallel to the axis, with the first case 5 and the second case 33 combined together. In the example shown in FIG. 5, the stationary blade 61 is formed by combining the web 23 of the first axial-flow fan unit 1 and the web 47 of the second axial-flow fan unit 3. As shown in the figure, the front blade 28 is curved in the transverse cross section so that its concave portion opens toward the direction R1 while the rear blade 51 is curved in the transverse cross section so that its concave portion opens toward the other direction R2. The stationary blade 61 is curved in the transverse cross section so that its concave portion opens toward the other direction and also toward a direction in which the rear blade 51 is positioned.

Figure 6:
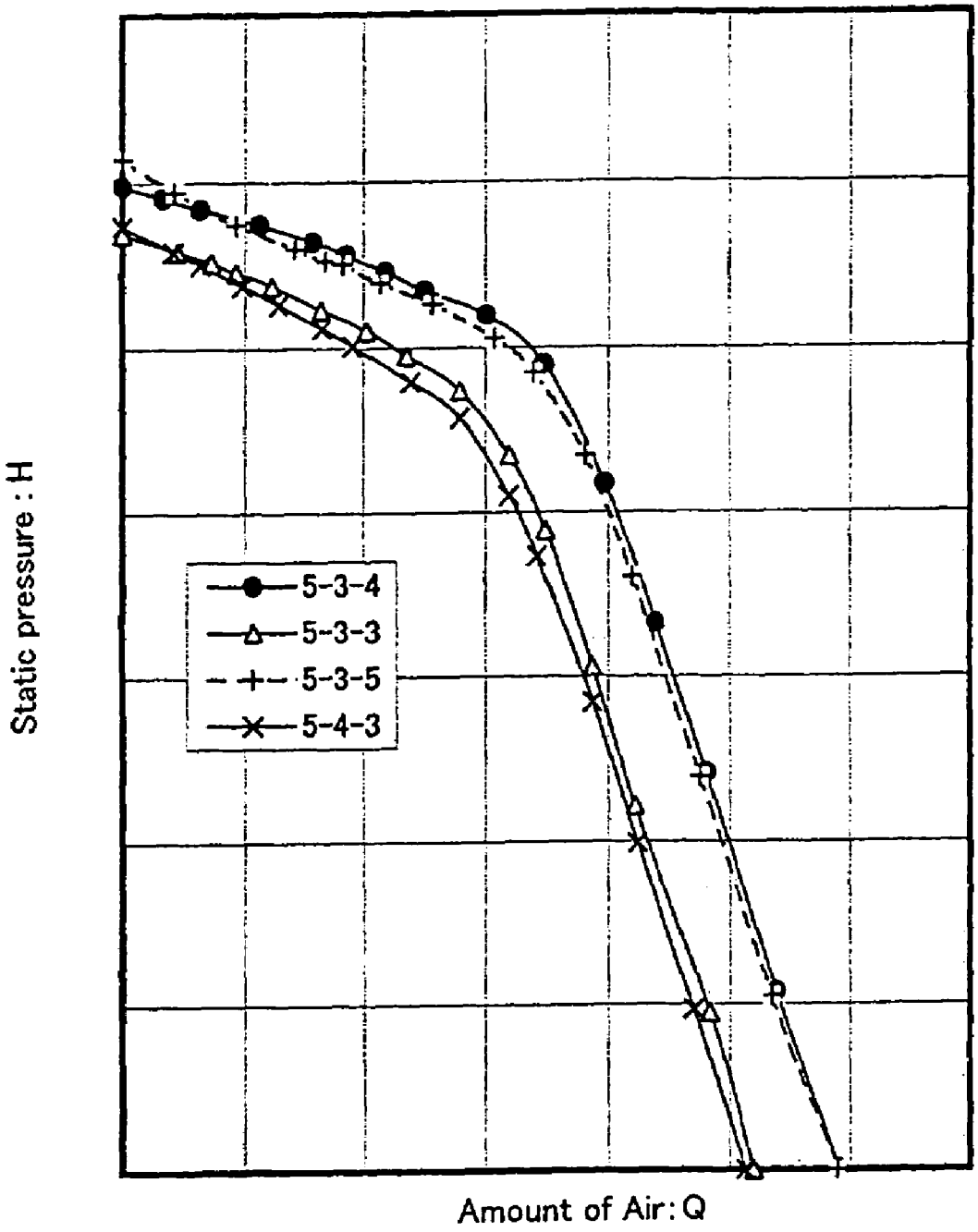
FIG. 6 is a graph showing a relation between an amount of air and a static pressure of the axial-flow fan with double impellers rotating in mutually opposite directions used in a test.

A variety of fans of the similar construction to that of this embodiment with different number of front blades, stationary blades and rear blades were fabricated, and an examination was made in respect of a relationship between an amount of air and a static pressure in each of these fans by operating these fans at the same speeds. The second impellers of these fans were rotated at 67% of the speed of the first impellers. FIG. 6 shows the result of measurements. In FIG. 6, a line marked with ● represents a result of measurement on this embodiment of a fan with five front blades, three stationary blades and four rear blades; a line marked with Δ represents a result on a fan with five front blades, three stationary blades and three rear blades; a line marked with + represents a result on a fan with five front blades, three stationary blades and five rear blades; and a line marked with x represents a result on a fan with five front blades, four stationary blades and three rear blades. FIG. 6 shows air amount and static pressure values for other fans in comparison with those of this embodiment (5-3-4), with the air amount and static pressure of this embodiment defined as Q and H respectively. FIG. 6 shows that the fan of this embodiment with five front blades, three static blades and four rear blades is capable of producing a larger amount of air and a higher static pressure than other fans.

Table 1 shows a suction noise [dB(A)] and power consumption of each fan when the second impeller is rotated at 67% of the speed of the first impeller, as in the test of FIG. 6. In Table 1, a number-of-blades column shows the number of front blades, static blades and rear blades in that order, and a suction noise [dB(A)] column and a power consumption column show values relative to the suction noise Lp and power consumption P of the fan of this embodiment (5-3-4).

TABLE 1

| No. of blades | Suction noise | Power consumption |
|---|---|---|
| 5-3-4 | Lp | P |
| 5-3-5 | Lp + 2 | P × 1.10 |
| 5-3-3 | Lp + 5 | P × 1.15 |
| 5-4-3 | Lp ± 0 | P × 1.06 |

Figure 7:
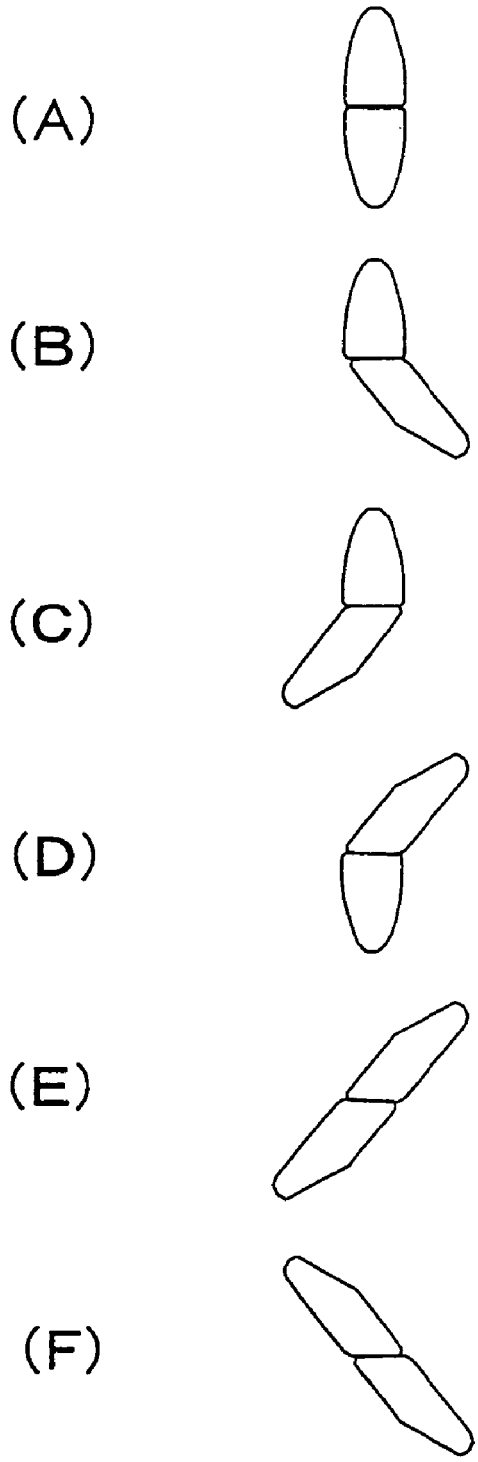
FIGS. 7A–7F are transverse cross-sectional views of stationary blades in examples 1–6 of the axial-flow fan with double impellers rotating in mutually opposite directions used in a test.

Next, a variety of fans were made in such a manner that stationary blades of the fans have a different transverse cross section shape from that of this embodiment, but in other respects they are similar in construction to this embodiment. A current value, a maximum air amount, a maximum static pressure and suction noise were measured for each fan. Table 2 shows a result of measurements. In Table 2, the fans of examples 1–6 for comparison have stationary blades of transverse cross sections shown in FIGS. 7A–7F. That is, the static blades of example 1 [FIG. 7A] have no concave portions but extends in the axial direction. The static blades of example 2 [FIG. 7B] are curved in transverse cross section in such a manner that their concave portions open toward the direction R1 and toward a direction in which the front blades 28 are positioned. The static blades of example 3 [FIG. 7C] are curved in transverse cross section in such a manner that their concave portions open toward the direction R2 and toward a direction in which the front blades 28 are positioned. The static blades of example 4 [FIG. 7D] are curved in transverse cross section in such a manner that their concave portions open toward the direction R1 and toward a direction in which the rear blades 51 are positioned. The static blades of example 5 [FIG. 7E] have no concave portions but are inclined in such a manner that they approach the rear blades 51 as they extend in the direction R2. The static blades of example 6 [FIG. 7F] have no concave portions but are inclined in such a manner that they approach the front blades 28 as they extend in the direction R2. Further, in Table 2, the first impeller rotating speed, second impeller rotating speed, current value, maximum air amount, static pressure and suction noise [dB(A)] represent values relative to the corresponding values, N1, N2, I, Q, H, Lp, of the fan of this embodiment.

TABLE 2

| | 1st impeller rotating speed | 2nd impeller rotating speed | Current | Max. air amount | Max static pressure | Suction noise (dB[A]) |
|---|---|---|---|---|---|---|
| Embodiment | N1 | N2 = N1 × 0.67 | I | Q | H | Lp |
| Example 1 | N1 × 1.02 | N2 × 1.07 | I × 0.98 | Q × 1.02 | H × 0.97 | Lp + 2 |
| Example 2 | N1 × 1.00 | N2 × 1.00 | I × 1.00 | Q × 1.00 | H × 0.97 | Lp ± 0 |
| Example 3 | N1 × 1.00 | N2 × 1.11 | I × 0.97 | Q × 0.95 | H × 0.97 | Lp + 2 |
| Example 4 | N1 × 1.00 | N2 × 1.06 | I × 0.98 | Q × 0.97 | H × 1.02 | Lp + 2 |
| Example 5 | N1 × 0.98 | N2 × 1.11 | I × 0.98 | Q × 0.88 | H × 1.00 | Lp + 4 |
| Example 6 | N1 × 1.00 | N2 × 0.97 | I × 1.02 | Q × 0.97 | H × 1.00 | Lp + 1 |

From Table 2, it is understood that a fan with the stationary blade having the same transverse cross section as this embodiment can produce a greater maximum air amount, a higher maximum static pressure and less suction noise than those fans with stationary blade having the transverse cross sections of the examples 1–6, by making appropriate adjustments on the rotating speed.

Figure 8:
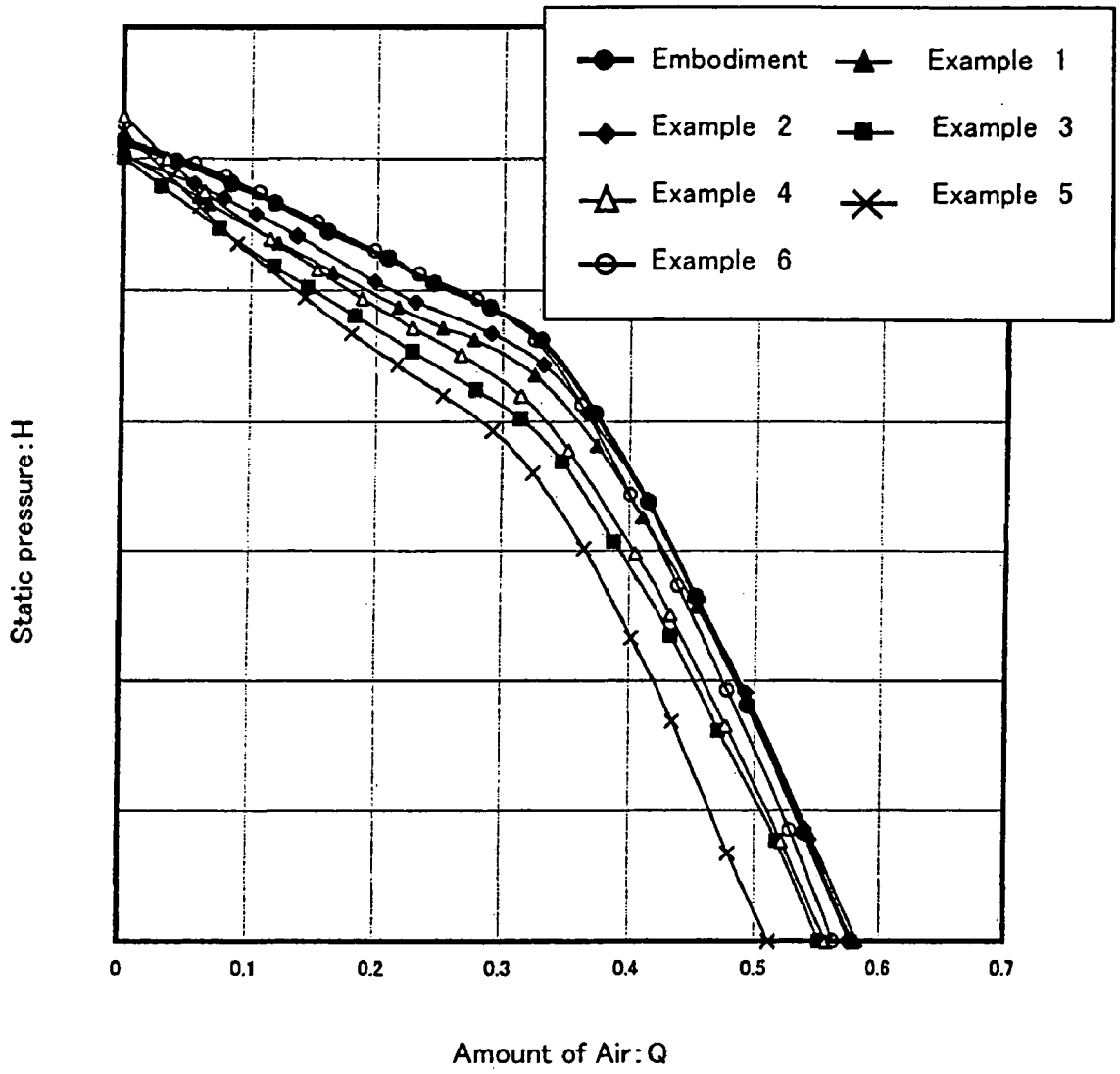
FIG. 8 is a graph showing a relation between an amount of air and a static pressure of the axial-flow fan with double impellers rotating in mutually opposite directions used in a test.

Further, FIG. 8 shows a relation between an amount of air and static pressure for each fan when the fan of this embodiment and the fans of examples 1–6 are operated under the same conditions as the test of Table 2. The air amounts and the static pressures shown in FIG. 8 represent values relative to the corresponding values Q and H of the fan of this embodiment (5-3-4). From FIG. 8 it is seen that the fan of this embodiment can produce a larger amount of air and a higher static pressure than the fans of examples 1–6.

Figure 9:
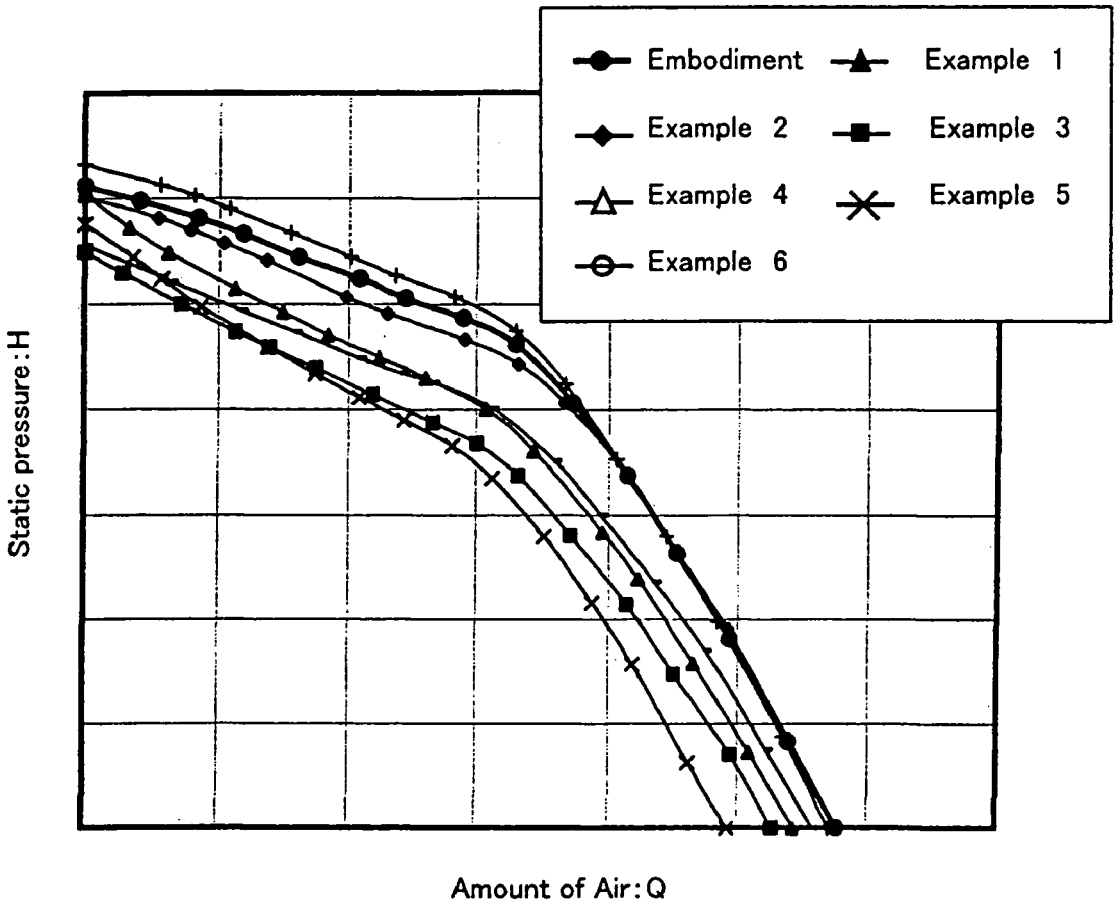
FIG. 9 is a graph showing a relation between an amount of air and a static pressure of the axial-flow fan with double impellers rotating in mutually opposite directions used in a test.

Table 3 shows current values, maximum air amounts, maximum static pressures and suction noise for the fan of this embodiment and the fans of examples 1–6 when they are operated at the same speed. FIG. 9 shows a relation between an amount of air and static pressure for each of the fans of this embodiment and examples 1–6 when they are operated under the same conditions as the test of Table 3.

TABLE 3

| | 1st impeller rotating speed | 2nd impeller rotating speed | Current | Max. air amount | Max static pressure | Suction noise (dB[A]) |
|---|---|---|---|---|---|---|
| Embodiment | N1 | N2 = N1 × 0.67 | I | Q | H | Lp |
| Example 1 | N1 × 1.00 | N2 × 1.00 | I × 0.87 | Q × 0.97 | H × 0.90 | Lp + 1 |
| Example 2 | N1 × 1.00 | N2 × 1.00 | I × 1.00 | Q × 1.00 | H × 0.97 | Lp ± 0 |
| Example 3 | N1 × 1.00 | N2 × 1.00 | I × 0.85 | Q × 0.91 | H × 0.89 | Lp + 1 |
| Example 4 | N1 × 1.00 | N2 × 1.00 | I × 0.92 | Q × 0.93 | H × 0.97 | Lp + 2 |
| Example 5 | N1 × 1.00 | N2 × 1.00 | I × 0.88 | Q × 0.84 | H × 0.94 | Lp + 3 |
| Example 6 | N1 × 1.00 | N2 × 1.00 | I × 1.07 | Q × 0.98 | H × 1.02 | Lp + 2 |

From FIG. 9 it is understood that the fan of this embodiment can produce a larger amount of air and a higher static pressure than those of the fans of examples 1–5. It is also seen that while the fan of this embodiment has almost the same air amount and static pressure as those of example 6, the fan of example 6 consumes a higher current and produces greater suction noise than those of this embodiment.

INDUSTRIAL APPLICABILITY

With this invention, by setting the number of front blades, stationary blades and rear blades to five, three and four respectively, it is possible to produce a larger amount of air and a higher static pressure than can be achieved with conventional fans. It is also possible to realize a reduction in noise. This provides a better cooling effect on electric appliances than the conventional fans.

Further, when the first rotating operation to couple the first case with the second case is performed, the first kind of engaging structure resists the first rotating action; and when the second rotating operation to rotate the first case relative to the second case in another direction opposite to the one direction is performed, the second kind of engaging structure resists the second rotating action. Therefore, if the first axial-flow fan unit and the second axial-flow fan unit are subjected to a force that acts in a direction opposite to the direction in which the two fans are rotated for coupling, the second kind of engaging structure can prevent a possible decoupling of the two fans.

The invention claimed is:

1. An axial-flow fan with double impellers comprising:

a housing having an air channel therein, the air channel having a suction opening portion on one of axial-end sides thereof and a discharge opening portion on the other axial-end side thereof;

a first impeller having a plurality of front blades and being adapted to rotate in the suction opening portion;

a first motor to rotate the first impeller about an axis of the fan in one of two rotating directions;

a second impeller having a plurality of rear blades and being adapted to rotate in the discharge opening portion;

a second motor to rotate the second impeller about the axis in the other rotating direction opposite to the one direction; and a plurality of stationary blades radially extending and arranged stationary in the housing between the first impeller and the second impeller;

wherein the number of the front blades is five, the number of the stationary blades is three, and the number of the rear blades is four.

2. The axial-flow fan with double impellers as defined in claim 1, wherein the front blades are curved in a transverse cross section of the front blades as taken along a direction parallel to the axis so that concave portions thereof are open toward the one direction;

wherein the rear blades are curved in a transverse cross section of the rear blades as taken along a direction parallel to the axis so that concave portions thereof are open toward the other direction; and wherein the stationary blades are curved in a transverse cross section of the stationary blades as taken along a direction parallel to the axis so that concave portions thereof are open toward the other direction and toward a direction in which the rear blades are positioned.

3. The axial-flow fan with double impellers as defined in claim 2, wherein the first impeller has an annular peripheral wall surrounding the axis on which base portions of the five front blades are integrally mounted; and wherein the second impeller has an annular peripheral wall surrounding the axis on which base portions of the four rear blades are integrally mounted.

4. The axial-flow fan with double impellers as defined in claim 3, wherein a rotating speed of the second impeller is slower than that of the first impeller.

5. The axial-flow fan with double impellers comprising:

a first axial-flow fan unit which comprises: a first case including therein an air channel having a suction opening portion on one of axial-end sides thereof and a discharge opening portion on the other axial-end side thereof; a first impeller having a plurality of front blades and being adapted to rotate in the suction opening portion; a first motor to rotate the first impeller about an axis of the fan in one of two rotating directions; and a plurality of webs circumferentially spaced apart and installed in the discharge opening portion to secure the first motor to the first case; and a second axial-flow fan unit which comprises: a second case including therein an air channel having a suction opening portion on one of axial-end sides thereof and a discharge opening portion on the other axial-end side thereof; a second impeller having a plurality of rear blades and being adapted to rotate in the discharge opening portion; a second motor to rotate the second impeller about the axis in the other rotating direction opposite to the one direction; and a plurality of webs circumferentially spaced apart and installed in the suction opening portion to secure the second motor to the second case;

wherein the first case of the first axial-flow fan unit and the second case of the second axial-flow fan unit are coupled to form a housing;

wherein the plurality of webs of the first axial-flow fan unit and the plurality of webs of the second axial-flow fan unit are combined to form a plurality of stationary blades arranged stationary in the housing between the first impeller and the second impeller; and wherein the number of the front blades is five, the number of the stationary blades is three, and the number of the rear blades is four.

6. The axial-flow fan with double impellers as defined in claim 5, wherein the front blades are curved in a transverse cross section of the front blades as taken along a direction parallel to the axis so that concave portions thereof are open toward the one direction;

wherein the rear blades are curved in a transverse cross section of the rear blades as taken along a direction parallel to the axis so that concave portions thereof are open toward the other direction; and wherein the stationary blades are curved in a transverse cross section of the stationary blades as taken along a direction parallel to the axis so that concave portions are open toward the other direction and toward a direction in which the rear blades are positioned.

7. The axial-flow fan with double impellers as defined in claim 6, wherein the first impeller has an annular peripheral wall surrounding the axis on which base portions of the five front blades are integrally mounted; and wherein the second impeller has an annular peripheral wall surrounding the axis on which base portions of the four rear blades are integrally mounted.

8. The axial-flow fan with double impellers as defined in claim 7, wherein a rotating speed of the second impeller is slower than that of the first impeller.

9. The axial-flow fan with double impellers comprising:

a first axial-flow fan unit comprises: a first case including therein an air channel having a suction opening portion on one of axial-end sides thereof and a discharge opening portion on the other axial-end side thereof, and a first impeller having a plurality of blades and being adapted to rotate in the suction opening portion; and a second axial-flow fan unit comprises: a second case including therein an air channel having a suction opening portion on one of axial-end sides thereof and a discharge opening portion on the other axial-end side thereof, and a second impeller having a plurality of blades and being adapted to rotate in the discharge opening portion;

wherein the first case of the first axial-flow fan unit and the second case of the second axial-flow fan unit are combined through a coupling structure;

wherein the coupling structure comprises: two kinds of engaged portions provided at an end portion surrounding a periphery of the discharge opening portion of the first case of the first axial-flow fan unit; and two kinds of engaging portions provided at an end portion surrounding a periphery of the suction opening portion of the second case of the second axial-flow fan unit and adapted to engage with the two kinds of engaged portions;

wherein the two kinds of engaging portions and the two kinds of engaged portions include:

a first kind of the engaging portions and a first kind of the engaged portions together forming a first kind of engaging structure, the first kind of engaging structure being adapted to resist a separation operation when the first case and the second case in a coupled state are subjected to the separation operation which acts to axially separate the first case and the second case, the first kind of engaging structure being also adapted to resist a first rotation operation when the first case and the second case in a combined state are subjected to the first rotation operation which acts to rotate the first case about an axis relative to the second case in one of two rotating directions; and a second kind of the engaging portions and a second kind of the engaged portions together forming a second kind of engaging structure, the second kind of engaging structure being adapted to resist a second rotation operation when the first case and the second case in a coupled state are subjected to the second rotation operation which acts to rotate the first case about the axis relative to the second case in the other direction opposite to the one direction; and, wherein the first kind of the engaging portions and the first kind of the engaged portions together forming the first kind of engaging structure are brought into an engaged state by bringing the end portion of the first case and the end portion of the second case close together, and the second kind of the engaging portions and the second kind of the engaged portions together forming the second kind of engaging structure are brought into an engaged state by rotating the first case about the axis relative to the second case in the one direction.

10. The axial-flow fan with double impellers as defined in claim 9, wherein the first kind of the engaging portion comprises: a hook having a first engaging surface and a second engaging surface, the first engaging surface being adapted to engage with a first engaged surface of the first kind of the engaged portion when the first case and the second case in a coupled state are subjected to the separation operation that acts to axially separate the two cases, the second engaging surface being adapted to engage with a second engaged surface of the first kind of the engaged portion when the first case and the second case in a coupled state are subjected to the first rotation operation that acts to rotate the first case about the axis relative to the second case in the one direction;

wherein the second kind of the engaging portion comprises: a protrusion having a third engaging surface, the third engaging surface being adapted to engage with a third engaged surface of the second kind of the engaged portion when the first case and the second case in a coupled state are subjected to the second rotation operation that acts to rotate the first case about the axis relative to the second case in the other direction; and wherein the first kind of the engaged portion comprises a first fitting groove having the first and second engaged surface, and the second kind of the engaged portion comprises a second fitting groove having the third engaged surface.

11. The axial-flow fan with double impellers as defined in claim 10, wherein the end portions of the first case and the second case have an almost rectangular outline respectively, one of the hooks and one of the protrusions are integrally provided at each of at least three of four corner portions in the end portion of the first case, and one of the first fitting grooves and one of the second fitting grooves are formed in each of at least three of four corner portions of the second case.

12. An axial-flow fan with double impellers comprising:

a first axial-flow fan unit which comprises: a first case including therein an air channel having a suction opening portion and a discharge opening portion on both axial-end sides thereof, and a first impeller having a plurality of blades and being adapted to rotate in the suction opening portion; and a second axial-flow fan unit which comprises: a second case including therein an air channel having a suction opening portion and a discharge opening portion on both axial-end sides thereof, and a second impeller having a plurality of blades and being adapted to rotate in the discharge opening portion;

wherein the first case of the first axial-flow fan unit and the second case of the second axial-flow fan unit are combined through a coupling structure;

wherein the end portions of the first case and the second case have an almost rectangular outline respectively, one first fitting groove and one second fitting groove are formed in each of at least three of four corner portions of the first case, and one hook and one protrusion are integrally provided at each of at least three of four corner portions in the end portion of the second case;

wherein the hooks and the first fitting grooves are so shaped as to form a first kind of engaging structure, the first kind of engaging structure being adapted to resist a separation operation when the first case and the second case in a coupled state are subjected to the separation operation which acts to axially separate the first case and the second case, the first kind of engaging structure being also adapted to resist a first rotation operation when the first case and the second case in a combined state are subjected to the first rotation operation which acts to rotate the first case about an axis relative to the second case in one of two rotating directions; and wherein the protrusions and the second fitting grooves are so shaped as to form a second kind of engaging structure, the second kind of engaging structure being adapted to resist a second rotation operation when the first case and the second case in a coupled state are subjected to the second rotation operation which acts to rotate the first case about the axis relative to the second case in the other direction opposite to the one direction.

* * * * *

UNITED STATES PATENT AND TRADEMARK OFFICE

CERTIFICATE OF CORRECTION

PATENT NO. : 7,156,611 B2
APPLICATION NO. : 10/500603
DATED : January 2, 2007
INVENTOR(S) : Oosawa et al.

It is certified that error appears in the above-identified patent and that said Letters Patent is hereby corrected as shown below:

Column 14, Line 44, (Claim 5, Line 1), delete “The” and insert --An--.

Column 15, Line 33, (Claim 9, Line 1), delete “The” and insert --An--.

Signed and Sealed this

Sixth Day of March, 2007

JON W. DUDAS
*Director of the United States Patent and Trademark Office*